United States Patent [19]

Parkes

[11] 4,162,136

[45] Jul. 24, 1979

[54] COOLED BLADE FOR A GAS TURBINE ENGINE

[75] Inventor: Roger J. Parkes, Stanton-by-Bridge, England

[73] Assignee: Rolls-Royce Limited, London, England

[21] Appl. No.: 563,144

[22] Filed: Apr. 1, 1975

[30] Foreign Application Priority Data

Apr. 5, 1974 [GB] United Kingdom ..... 15310/74

[51] Int. Cl.[2] ..... F01D 5/18

[52] U.S. Cl. ..... 416/97 R; 416/96 A; 415/115

[58] Field of Search ..... 416/90, 95, 96 A, 97 A, 416/233, 500, 96 R, 97 R; 415/115; 267/150

[56] References Cited

U.S. PATENT DOCUMENTS

| | | | |
|---|---|---|---|
| 2,912,223 | 11/1959 | Hull | 416/500 |
| 3,628,885 | 12/1971 | Sidenstick et al. | 416/95 |
| 3,691,822 | 9/1972 | Deckard | 267/150 |
| 3,806,275 | 4/1974 | Aspinwall | 415/115 |
| 3,930,748 | 1/1976 | Redman et al. | 415/115 |

FOREIGN PATENT DOCUMENTS

| | | | |
|---|---|---|---|
| 666536 | 2/1952 | United Kingdom | 415/115 |
| 936508 | 9/1963 | United Kingdom | 415/115 |

*Primary Examiner*—Verlin R. Pendegrass
*Attorney, Agent, or Firm*—Cushman, Darby & Cushman

[57] ABSTRACT

A cooled blade for a gas turbine engine comprises an aerofoil portion having a longitudinally extending hollow. An air entry tube is mounted within the hollow and is pressed against a locating surface within the hollow by a resilient member such as a spring tube.

7 Claims, 3 Drawing Figures

COOLED BLADE FOR A GAS TURBINE ENGINE

This invention relates to a cooled blade for a gas turbine engine.

Throughout this specification the term 'blade' is used in its wide sense to include rotor and stator blades and vanes.

A well known method of providing cooling for blades for gas turbine engines uses a hollow blade within which is mounted a cooling air entry tube. Cooling air is fed to the inside of this tube and flows out through apertures in the tube upon the inside surface of the hollow blade to cool it. One difficulty arising with this construction lies in the provision of means for supporting the tube. In conditions of high vibration or centrifugal loading it is necessary to support the tube at positions spaced all along its length. The common way of providing this support is to provide ribs or other locating features on the inside of the hollow blade, and to make the tube a tight fit between these protrusions. This construction makes assembly of the tube into the blade difficult and may be damaging to the blade interior.

The present invention provides a construction which enables relatively easy assembly of the tube into the blade.

According to the present invention a cooled blade for a gas turbine engine comprises an aerofoil portion having a cavity therein, a cooling air entry tube within the cavity, part of the interior surface of the cavity forming a locating surface for the cooling air entry tube, and a resilient tube trapped between said tube and part of the interior surface of the cavity so that it presses said tube against said locating surface.

Said locating surface may comprise a plurality of locating protrusions.

Said resilient tube may comprise a tube of resilient material having a longitudinally extending slot cut through its wall.

Said cavity may be formed in the leading edge section of the blade, the remainder of the blade being cooled by a sinuous passage formed therein.

The invention also comprises a method of assembling the blade in which the cooling air tube is assembled into the cavity and retained in its correct position in the tube by temporary retention means, a hole of slightly smaller diameter than the resilient tube is drilled or otherwise formed between the cooling tube and the interior of the cavity, the hole extending longitudinally of the tube, the resilient tube is then inserted into the hole, and the temporary retention means removed.

Preferably both the cooling air tube and the resilient tube are also retained into the blade by brazing.

Figure 1:
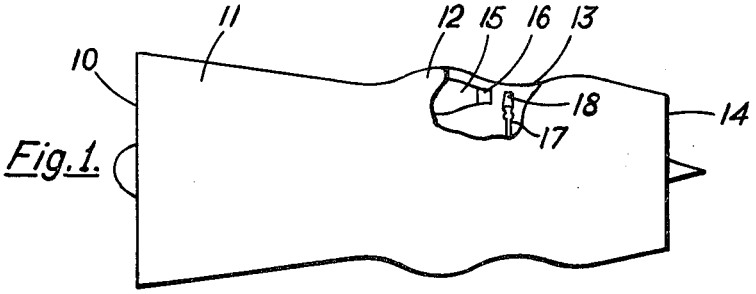
Figure 2:
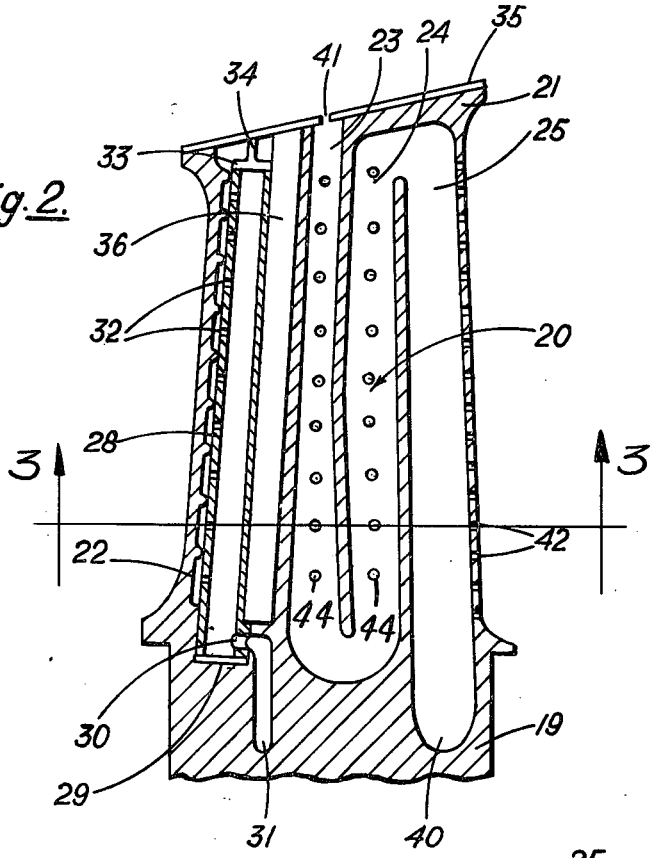
Figure 3:
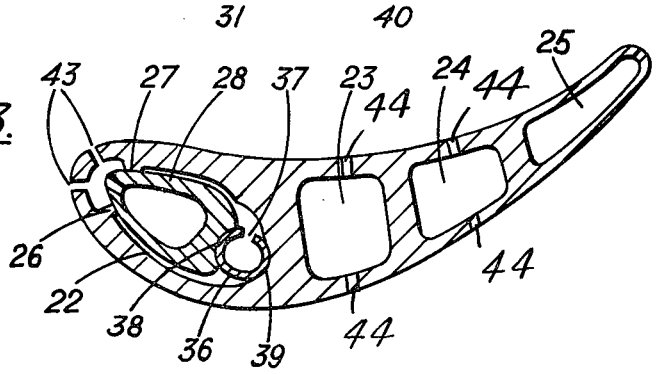

The invention will now be particularly described, merely by way of example, with reference to the accompanying drawings in which:

FIG. 1 is a partly cut-away view of a gas turbine engine having blades in accordance with the invention, FIG. 2 is a sectional view substantially on the mid-chord line of one of the blades of FIG. 1, and FIG. 3 is a section on the line 3—3 of FIG. 2.

In FIG. 1 there is shown a gas turbine engine comprising in flow series an air intake 10, compressor section 11, combustion section 12, turbine section 13 and final nozzle 14. The casing of the engine is shown broken-away in the region of the combustion and turbine sections to expose the combustion chamber 15, the nozzle guide vanes 16, the turbine rotor 17 and the turbine rotor blades 18.

These rotor blades are shown in greater detail in FIGS. 2 and 3. In FIG. 2 it will be seen that the blade 18 comprises a root portion 19, an aerofoil section 20 and a tip shroud 21. The aerofoil section 20 is hollow, and has formed within it a longitudinally extending leading edge cavity 22 and three longitudinally extending cavities 23, 24 and 25 spaced along the chord of the blade in order, with the cavity 25 extending adjacent the trailing edge of the blade.

The leading edge cavity 22 takes up most of the leading edge section of the blade, leaving only a relatively thin skin of metal to form the blade aerofoil surface in this region. The interior wall of the cavity is provided with a plurality of locating protrusions 26 and 27 from the convex and concave surface sides of the blades respectively, these protrusions being provided with flat tops which act as locations for the cooling air tube described below.

Within the cavity 22 there extends a cooling air entry tube 28; as can best be seen from FIG. 3 the section of this tube corresponds roughly in shape to the section of the cavity 22, and the tube abuts against the tops of the protrusions 26 and 27. The tube extends to the root extremity of the cavity 22, where it is provided with a cover plate 29 which blocks off its end, and an air entry hole 30 which communicates with a passage 31 in the root portion 19 of the blade. The passage 31 extends to the surface of the root portion where it communicates with a source of cooling air.

Along its length the tube 28 is provided with a plurality of impingement holes 32 directed towards the inner surface of the leading edge of the blade, while at its extremity distant from the cover plate 29 a further cover plate 33 seals off this end of the tube. This plate is also provided with a projection 34, which abuts against the inner surface of a plate 35 which covers the upper surface of the shroud.

To hold the tube 28 in position against the protrusions 26 and 27 a resilient tube 36 extends parallel with the tube 28 inside the cavity 22. FIG. 2 is made to differ from a true mid-chord section in such a way that the tube 36 may be seen, and it will be noted that it substantially coextends with the tube 28, abutting at its upper end with the inner surface of the plate 35 and stopping at its lower end just short of the air entry hole 30. From FIG. 3 it can be seen that the resilient tube 36 has a longitudinally extending split 37; the tube 26 thus made resilient by virtue of the split 37 being able to be closed up by diametrical pressure on the tube. The resilient tube is retained between a longitudinal depression 38 in the cooling air tube 28 and an opposed similar depression 39 in the cavity 22; these depressions are made as described below to provide a space between them slightly smaller than the unstressed diameter of the resilient tube 36, and thus the tube 36 presses the cooling air tube 28 resiliently against the projections 26 and 27.

The tube 28 is thus held along substantially all its length against the protrusions, and is held against vibrational movement. In this particular embodiment, the tubes 28 and 36 are also held in the cavity 22 adjacent their lower extremities by brazing.

Turning to the three rearward cavities 23, 24 and 25, these are joined at alternate ends to produce a single sinuous passage which extends to an air entry duct 40 in the root portion which is provided with a supply of cooling air. The other extremity of the sinuous passage is at the outer end of the cavity 23 where a hole 41 in the plate 35 allows excess air to leave the blade. Cooling air holes 42 are provided in the trailing edge of the blade to allow air to exhaust from the cavity and provide cooling of this area, while film cooling holes may be provided to allow air to flow from the inside to the outside surface of the blade to provide film cooling. In particular holes 43 are provided which communicate with the cavity 22 and allow air to flow from the cavity to film cool the leading edge.

Thus the overall cooling system of the blade is that cooling air enters the blade through the passages 31 and 40, and feeds the cooling air tube 28 and the cavity 25 respectively. Air entering the tube 28 flows out through the impingement holes 32 to impinge on the inside of the leading edge in the form of jets and cools the metal; the air then flows through the film cooling holes 43 and provides film cooling for the leading edge area. Some of the air entering the cavity 25 flows out through the holes 42, while the remainder flows through the sinuous passage made up of cavities 23, 24 and 25 and provides cooling. Some of the air may exhaust through film cooling holes 44, while the remainder leaves via the hole 41.

We propose that in order to assemble the tubes 28 and 36 in their places, the following method is used; the tube 28 complete with cover plates 29 and 33 is assembled into the cavity 22, but neither of the depressions 38 and 39 are formed initially. A temporary location, such as a setscrew is used to locate the tube 28 against the projections 26 and 27, and the depressions 38 and 39 are then formed by drilling out a hole slightly smaller in diameter than the unstressed diameter of the tube 36 in between the tube 28 and the wall of the cavity 22. The temporary location is then removed and the tube 36 is forced into place between the depressions. The tubes are brazed at their lower ends into the cavity, the tops of the projection 34 and the tube 36 are machined level with the upper surface of the shroud, and the plate 35 is then brazed into position, retaining the tubes in place.

It will be noted that the present construction could be used to retain tubes in stators as well as rotors, and that these tubes could be located in any part of the blade section. The resilient member could also be a complete tube of thin metal rather than the split tube described, or it could comprise any other form of longitudinally extending resilient member such as a shaped thin metal channel piece.

I claim:

1. A cooled blade for a gas turbine engine comprising an aerofoil portion having a cavity therein, a cooling air entry tube within the cavity, said cavity having an interior surface with a part which forms a locating surface for said tube, a longitudinally extending depression formed in the outer surface of said cooling air entry tube, a further part of the interior surface of the cavity having a longitudinally extending depression facing the depression formed in the outer surface of said cooling air entry tube, and a resilient tube trapped between the depressions in said cooling air entry tube and said further part.

2. A cooled blade as claimed in claim 1 and in which said locating surface has a plurality of locating protrusions formed thereon.

3. A cooled blade as claimed in claim 1 and in which said resilient member and said cooling air entry tube are also retained in the blade by brazing.

4. A cooled blade as claimed in claim 1 and in which said cooling air entry tube has apertures in its wall through which cooling air may blow on to the interior of said cavity.

5. A cooled blade as claimed in claim 4 and in which said cavity is formed in the leading part of said aerofoil portion, the remainder of the aerofoil portion being provided with a sinuous passage formed therein for the passage of cooling air.

6. A cooled blade as claimed in claim 1 and comprising a cap metallurgically bonded to the tip of the blade to cover said cavity.

7. A cooled blade as claimed in claim 1 in which said resilient tube comprises a tube whose wall is made of a resilient material and has a longitudinally extending slot cut therethrough along its entire length.

* * * * *